US008697325B2

(12) United States Patent
Yamada et al.

(10) Patent No.: US 8,697,325 B2
(45) **Date of Patent: *Apr. 15, 2014**

(54) CARRIER CORE MATERIAL FOR ELECTROPHOTOGRAPHIC DEVELOPER AND METHOD FOR PRODUCING THE SAME, CARRIER FOR ELECTROPHOTOGRAPHIC DEVELOPER, AND ELECTROPHOTOGRAPHIC DEVELOPER

(76) Inventors: Tomoya Yamada, Okayama (JP); Takashi Fujiwara, Okayama (JP); Ryusuke Nakao, Okayama (JP); Yukihiro Matuda, Okayama (JP); Tomokazu Mouri, Okayama (JP)

( * ) Notice: Subject to any disclaimer, the term of this patent is extended or adjusted under 35 U.S.C. 154(b) by 625 days.

This patent is subject to a terminal disclaimer.

(21) Appl. No.: 12/449,866

(22) PCT Filed: Mar. 21, 2008

(86) PCT No.: PCT/JP2008/055285

§ 371 (c)(1),
(2), (4) Date: Oct. 22, 2009

(87) PCT Pub. No.: WO2008/117752

PCT Pub. Date: Oct. 2, 2008

(65) Prior Publication Data

US 2010/0035174 A1 Feb. 11, 2010

(30) Foreign Application Priority Data

Mar. 23, 2007 (JP) ..... 2007-077697

(51) Int. Cl.
*G03G 9/113* (2006.01)

(52) U.S. Cl.
USPC ..... 430/111.32; 130/111.33

(58) Field of Classification Search
USPC ..... 430/111.32, 111.33
See application file for complete search history.

(56) References Cited

U.S. PATENT DOCUMENTS

2013/0011781 A1 * 1/2013 Kawauchi et al. ..... 430/111.34

FOREIGN PATENT DOCUMENTS

| | | | |
|---|---|---|---|
| EP | 1 729 181 | A1 | 12/2006 |
| EP | 1729181 | A1 * | 12/2006 |
| JP | A-10-010790 | | 1/1998 |
| JP | A-11-202550 | | 7/1999 |
| JP | A-2002-296846 | | 10/2002 |
| JP | A-2006-335615 | | 12/2006 |
| JP | A-2006-337828 | | 12/2006 |

OTHER PUBLICATIONS

Bearden, J. A.; X-ray Wavelengths and X-ray Atomic Energy Levels. US Dept of Commerce, National Bureau of Standards. NSRDS 14, pp. 1-47 (Sep. 1967).*

Supplementary European Search Report issued in corresponding European Application No. 08722639.9, mailed Feb. 23, 2010.

* cited by examiner

*Primary Examiner* — Christopher Rodee
(74) *Attorney, Agent, or Firm* — Oliff PLC

(57) ABSTRACT

To provide a carrier for an electrophotographic developer in which high image quality and full colorization are possible while carrier scattering is reduced, and a method for producing the carrier, and an electrophotographic developer including the carrier. A carrier core material for an electrophotographic developer is produced so that the half-value width B of a peak having a maximum intensity in an XRD pattern satisfies B≤0.160 (degree). A carrier for an electrophotographic developer and an electrophotographic developer are produced from the carrier core material for an electrophotographic developer.

10 Claims, 2 Drawing Sheets

CARRIER CORE MATERIAL FOR ELECTROPHOTOGRAPHIC DEVELOPER AND METHOD FOR PRODUCING THE SAME, CARRIER FOR ELECTROPHOTOGRAPHIC DEVELOPER, AND ELECTROPHOTOGRAPHIC DEVELOPER

TECHNICAL FIELD

The present invention relates to a carrier for a two-component electrophotographic developer used in a two-component electrophotographic developer, as a mixture with a toner.

BACKGROUND ART

In recent years, with the wide spread of apparatuses using an electrophotographic system, such as copiers and printers, those apparatuses are being put to a variety of uses. In the market, regarding the electrophotography, the demand for higher image quality is increasing, and regarding electrophotographic developers, a long service life is required.

Conventionally, in two-component electrophotographic developers, it has been considered that high grade electrophotography can be achieved by reducing the particle size of the toner in use. However, as the size of toner particles becomes smaller, the ability to charge the toner particles deteriorates. In order to cope with the deterioration of the ability to charge the toner particles, countermeasures are taken in such a way that the particle size is reduced and the specific surface area is increased, regarding the carrier for electrophotographic developer (hereafter, sometimes referred to as "carrier") used in the two-component electrophotographic developer, as a mixture with a toner. However, there is a problem that a carrier, with its particle size reduced, easily creates an abnormal phenomenon, such as adhesion and scattering of the carrier.

Herein, carrier adhesion is a phenomenon in which a carrier used in an electrophotographic developer scatters during the electrophotographic development process and adheres to the photoreceptor or other development apparatus.

In a development apparatus, the carrier is prevented from scattering by the existence of a magnetic force and an electrostatic force to let the carrier hold on the development sleeve against a centrifugal force added to the carrier by rotation of the development sleeve. However, in the carrier, with its particle size reduced, according to a related art, the centrifugal force obtained by the rotation of the development sleeve is greater than the holding force. Consequently, a phenomenon (carrier adhesion) occurs in which the carrier scatters from the magnetic brush and adheres to the photoreceptor. The carrier adhered to the photoreceptor sometimes unfavorably reaches the transfer unit. In result, an abnormal image is formed, because a toner image around the carrier is not transferred to transfer paper in the condition in which the carrier adheres to the photoreceptor.

In the related art, the carrier having a particle size of 22 μm or smaller is generally considered to cause carrier scattering, when the carrier with sample particle size is used. Therefore, it has been considered possible to prevent the carrier from scattering by taking a countermeasure in such a way that the content of the carrier having a particle size smaller than 22 μm is specified to be less than 1 wt % of the electrophotographic developer.

From the aforementioned viewpoint, for example, Patent Document 1 proposes a carrier, with a volume average particle size of core material particles set to be 25 μm to 45 μm, an average void diameter set to be 10 μm to 20 μm, proportion of particles having 22 μm or smaller particle size set to be less than 1%, magnetization in a magnetic field 1000 Oe set to be 67 emu/g-88 emu/g, and a difference between magnetization of scattered materials and that of a main body set to be 10 emu/g or smaller.

Patent Document 1: Published Unexamined Japanese Patent Application No. 2002-296846

DISCLOSURE OF INVENTION

Problems to be Solved by the Invention

However, as the result of the studies by the inventors of the present invention, even if a carrier which is the same level as the one described in Patent Document 1 was used, it was not possible to completely prevent the occurrence of carrier scattering.

The present invention is made under the above-mentioned circumstances, and the solution to problems to be solved by the present invention is to provide a carrier core material for an electrophotographic developer used in a carrier for an electrophotographic developer in which high image quality and full colorization are possible while carrier scattering is reduced, and also to provide a method for producing the carrier core material, a carrier for electrophotographic developer using the carrier core material for an electrophotographic developer, and an electrophotographic developer including the carrier.

Means for Solving the Problems

The inventors of the present invention have devoted themselves to study the cause of the above-mentioned carrier scattering which occurs when a small-particle-size carrier according to a conventional technology is used. Consequently, the inventors confirmed a completely new finding in which the occurrence of carrier scattering is attributed to carriers(carrier particles) having low magnetic susceptibility which exists in the carrier (hereafter, sometimes referred to as "low magnetic susceptibility particle").

According to the above-mentioned finding, due to the existence of low magnetic susceptibility particles in the carrier, the holding force among particles near the low magnetic susceptibility particles becomes locally weak in a magnetic brush formed by the carrier. Because the holding force among carriers(particles) becomes weak, carrier scattering has occurred in this weakened portion. Therefore, the amount of carrier scattering increases in proportion to the increase in the existence ratio of low magnetic susceptibility particles contained in the carrier.

Moreover, magnetic susceptibility described in the present invention is indicated, unless otherwise specified, by $\sigma_{1000}$ (unit: emu/g) which is a magnetic susceptibility in an external magnetic field 1000 Oe, and a low magnetic susceptibility particle is a particle in which $\sigma_{1000}<30$ emu/g.

Based on the above-mentioned finding, the inventors of the present invention studied the reduction of the existence ratio of low magnetic susceptibility particles in a carrier in order to prevent the carrier from scattering.

However, according to the study by the inventors, the existence ratio of low magnetic susceptibility particles in a carrier was extremely low, several hundred ppm or less, even in cases where serious carrier scattering occurs. Therefore, it was found that the existence ratio of low magnetic susceptibility particles cannot be measured correctly by ordinary sorting methods including a magnetic screening method.

Therefore, in evaluating the existence ratio of low magnetic susceptibility particles, the inventors of the present invention focused on the half-value width of the peak in the carrier's powder X-ray diffraction (XRD) pattern and found that as the half-value width of a carrier becomes narrower, the existence ratio of low magnetic susceptibility particles becomes lower, and thus, carrier scattering can be prevented.

Herein, a further explanation will be given for the finding that a carrier having a narrower half-value width can prevent the carrier from scattering.

The cause for the existence of low magnetic susceptibility particles in a carrier is the occurrence of a particle having a composition significantly different from that of the general population of the carrier due to some reason caused during the production process. This particle has the same crystalline structure as that of the general population of the carrier but has a different composition. Therefore, the lattice constant is changed. As a result, although the powder XRD pattern of the low magnetic susceptibility particle is similar to the powder XRD pattern of the general population of the carrier, the peak position is slightly deviated. Therefore, the powder XRD pattern of the carrier in which low magnetic susceptibility particles are mixed is configured so that a plurality of slightly deviated XRD patterns are overlapped and the peak is broad. On the contrary, it can be said that as the peak width in the XRD pattern of the carrier becomes narrower, the existence ratio of low magnetic susceptibility particles becomes lower.

As a result of further study by the inventors of the present invention, it was confirmed that the deviation of the peak position occurs not only due to deviation in the composition but also due to excess oxidation of the carrier, causing the peak in the XRD pattern to become broad. Needless to say, excess oxidation of the carrier is also a cause of the generation of low magnetic susceptibility particles.

Based on the above description, the inventors of the present invention found it possible to specify a carrier, which is prevented from scattering, by the use of the half-value width of the peak in the powder XRD pattern. Furthermore, the inventors also found a method for producing magnetic powder in which the half-value width of the peak in the powder XRD pattern is specified. Thus, the present invention was achieved.

That is, a first means to solve the problem is a carrier core material for an electrophotographic developer represented by a general formula $Mn_xFe_{3-x}O_4$ (where $0 \leq x \leq 1.0$), wherein the half-value width B of a peak having a maximum intensity in the powder XRD pattern satisfies $B \leq 0.160$ (degree).

A second means is a carrier core material for an electrophotographic developer described in the first means, wherein magnetic susceptibility $\sigma_{1000}$ under an external magnetic field 1000 Oe satisfies $\sigma_{1000} \geq 30$ emu/g.

A third means is a carrier core material for an electrophotographic developer described in the first or second means, wherein an average particle size is 10 μm or more and 80 μm or less.

A fourth means is a method for producing a carrier core material for an electrophotographic developer comprising the steps of:

forming an Fe raw material powder and an Mn raw material powder into slurry by making the powders fine and stirring the powders in a medium solution;

drying and granulating the obtained slurry to thereby obtain granulated powders;

firing the obtained granulated powders in an atmosphere, with an oxygen concentration set to be 1000 ppm or less, to thereby obtain a fired substance having a magnetic phase; and making the obtained fired substance powdered by a pulverizing process, so as to have a given particle size distribution thereafter.

A fifth means is a carrier for an electrophotographic developer, wherein the carrier core material for the electrophotographic developer described in any one of the first through third means is coated with resin.

A sixth means is an electrophotographic developer including the carrier for the electrophotographic developer described in the fifth means and a toner.

Effects of the Invention

According to the present invention, it was possible to provide a carrier for an electrophotographic developer and an electrophotographic developer capable of significantly reducing the scattering of the carrier in a developing machine when used as an electrophotographic developer for copiers, printers, and the like.

BEST MODE FOR CARRYING OUT THE INVENTION

Hereafter, the present invention will be described in sequential order of (1) a carrier core material for an electrophotographic developer, (2) a method for producing a carrier core material for an electrophotographic developer, (3) a carrier for an electrophotographic developer, and (4) an electrophotographic developer.

1. Carrier Core Material for an Electrophotographic Developer

<Powder XRD Pattern>

A carrier core material for an electrophotographic developer relating to the present invention (hereafter, sometimes referred to as "carrier core material") is created so that in the powder XRD pattern, the half-value width B of the maximum peak of a substance which becomes the core material satisfies $B \leq 0.160$ (degree). As stated above, it is indicated that the existence ratio of low magnetic susceptibility particles becomes lower as the half-value width of the material becomes narrower. Furthermore, when the value B satisfies the relation, the carrier scattering can be considerably reduced.

<Composition>

Any substance having magnetic characteristics suitable for the characteristics of the target electrophotographic development apparatus can be selected as a substance which becomes a carrier core material relating to the present invention. However, when considering image characteristics, magnetite, $Fe_3O_4$, and soft ferrite, $Mn_xFe_{3-x}O_4$, are preferably used. This is because these magnetic substances have sufficiently high magnetic susceptibility and low remanent magnetization.

<Particle Size>

It is preferable that the average particle size be 10 μm or more and 80 μm or less in the particle size distribution of a carrier core material relating to the present invention. If the particle size is larger than that range, image characteristics deteriorate, and if the particle size is too small, the magnetic force per particle decreases, making it difficult to prevent the carrier from scattering.

It is preferable that sorting by sieving be conducted during or after the production process so that the above-mentioned particle size distribution can be achieved.

2. Method for Producing a Carrier Core Material for an Electrophotographic Developer A magnetic powder generally used as a carrier core material is produced in such a way that a powder which becomes raw material is mixed, a binder or the like is added, the mixture is granulated to achieve the appropriate particle size, and then a magnetic phase is obtained by firing.

The inventors of the present invention devoted themselves to study a method for producing a magnetic powder having a narrow half-value width for the peak in the powder XRD pattern. Consequently, the inventors found it extremely effective to make a powder which becomes a raw material fine beforehand, sufficiently mix the raw material powder, and stably fire the powder under the partial pressure of oxygen required for the synthesis of the magnetic phase in the firing process.

First, an effect for making raw material powder fine and sufficiently mixing the raw material powder is to prevent the generation of low magnetic susceptibility particles by sufficiently mixing raw material particles in the mixing and granulating process and homogenizing the composition of each particle.

Next, the partial pressure of oxygen required for the synthesis of the magnetic phase in the firing process will be explained.

Generally, in the firing process, the firing is performed while granulated powder is in a firing container made of alumina or the like, and if the firing is performed in a condition where the partial pressure of oxygen is high, a magnetic force in the portion of the granulated powder which has been exposed to the outdoor air decreases due to excess oxidation. The decrease in the magnetic force of the granulated powder due to the excess oxidation causes the generation of the above-mentioned low magnetic susceptibility particles. On the other hand, by firing the granulated powder under the low partial pressure of oxygen, it is possible to prevent excess oxidation and reproducibly produce magnetic particles having constant magnetic susceptibility.

Hereafter, a production method for the carrier core material will be explained in detail for each process.

<Raw Material>

As raw material, an elemental substance of a component substance having a desired magnetic phase and a variety of chemical compounds, such as oxides or carbonates, are used.

For example, if spinel ferrite having a composition represented by $Mn_xFe_{3-x}O_4$ is produced, metals Fe, $Fe_3O_4$, and $Fe_2O_3$ can be preferably used as a source of the Fe supply, and metals Mn, $MnO_2$, $Mn_2O_3$, $Mn_3O_4$, and $MnCO_3$ can preferably be used as a source of the Mn supply. Each raw material is measured and mixed so that the compounding ratio of Fe and Mn components after the firing process will achieve the desired composition.

It is preferable that each raw material be made fine to achieve the average particle size of 1.0 μm or less in the dry condition where the raw material has not been granulated. Specifically, in order to produce a magnetic powder relating to the present invention, it is important that almost no particles having a diameter of 1.0 μm or more are contained in the raw material powder.

In order to obtain the above-mentioned fine raw material, the particle size should be adjusted by a pulverizing process for the raw material powder by a ball mill or a jet mill, etc. The pulverizing process can be performed at the stage of each raw material powder before the mixing process, or it can be performed at the stage after each raw material powder has been mixed so as to achieve a desired composition. The composition of each particle produced in the mixing and granulating process will be homogenized by using the above-mentioned fine raw material powder having an average particle size of 1.0 μm or less. Thus, it is possible to produce a magnetic powder, described later, having a narrow half-value width at the peak in the powder XRD pattern.

<Mixing and Formation of Slurry>

After the above-mentioned raw material has been measured so as to achieve a given composition ratio, the fine raw material powder is formed into a slurry by stirring the powder in a medium solution. It is preferable that the mixing ratio of the raw material powder and a medium solution be determined so that the concentration of solid content of the slurry becomes 50 to 90 mass %. For a medium solution, preparation is made by adding a binder, dispersant, or the like to water. As a binder, for example, polyvinyl alcohol can be preferably used, wherein its concentration in the medium solution can be 0.5 to 2 mass %. As a dispersant, for example, polycarboxylate ammonium can be preferably used, and its concentration in a medium solution can be 0.5 to 2 mass %. In addition, phosphorus, boric acid, or the like can be added as a lubricant or a calcination accelerator.

Herein, although each raw material can be formed into slurry by stirring the material in a container, it is preferable that the pulverizing process by a wet ball mill be applied in the process of slurry formation. This is because the raw material can be made into a fine powder while it is being mixed by applying the pulverizing process by a wet ball mill.

<Granulation>

Granulation can preferably be performed by introducing the above-mentioned slurried raw material into a spray drier. An ambient temperature in the dry spray process can be 100 to 300° C. By doing so, a granulated powder having a particle size of about 10 to 200 μm can be obtained. When considering the final particle size as a product, it is desirable that the particle size of the obtained granulated powder be controlled by removing too large granulated powder particles having a diameter of more than 100 μm by a vibrating sieve or the like.

<Firing>

Next, granulated powder is loaded into a heating furnace and fired, thereby obtaining a fired substance having a magnetic phase. Although the temperature for firing can be set within a temperature range in which a desired magnetic phase can be generated, for example, when producing magnetite, $Fe_3O_4$, or soft ferrite, $Mn_xFe_{3-x}O_4$, the firing is generally performed within the temperature range between 1000 and 1300° C. At this time, it is important to keep the partial pressure of oxygen in the furnace lower than the atmospheric pressure in order to produce magnetic particles having a narrow half-value width at the peak in the powder XRD pattern according to the present invention. Preferably, oxygen concentration in the furnace is set to 1000 ppm or less, more preferably, 200 ppm or less. This is to suppress the excess oxidation of granulated powder to be fired by reducing the partial pressure of oxygen in the furnace.

Control of the partial pressure of oxygen in the furnace can be achieved by allowing inert gases, such as nitrogen gas and argon gas, or mixed gases of those inert gases and oxygen to flow into the furnace.

A carrier core material according to the present invention can be obtained by the pulverizing process for the obtained fired substance by a hammer mill, ball mill, or the like to make the substance into a powder and then achieving the desired particle size distribution by sorting with a sieve thereafter.

3. Carrier for Electrophotographic Developer

A carrier according to the present invention can be obtained by coating a carrier core material, according to the present invention, with silicone resin or the like, providing for an electric charge, and increasing the durability. The coating method with the silicone resin or the like can be performed by a publicly known method.

4. Electrophotographic Developer

An electrophotographic developer according to the present invention can be obtained by mixing the carrier and an appropriate toner according to the present invention.

Embodiments

Hereafter, the present invention will be explained more specifically based on the embodiments.

(Embodiment 1)

A mixture was formed by dispersing 7.2 kg of $Fe_2O_3$ (average particle size 0.6 μm) and 2.8 kg of $Mn_3O_4$ (average particle size 0.9 μm) into 3.0 kg of deionized water and adding 60 g of polycarboxylate ammonium dispersant as a dispersant. A mixed slurry of $Fe_2O_3$ and $Mn_3O_4$ was obtained by the pulverizing process of the mixture using a wet ball mill (medium diameter 2 mm). The mixing ratio of raw material was calculated so that x=0.86 is achieved in the above-mentioned composition formula of ferrite $Mn_xFe_{3-x}O_4$.

When the particle size distribution of raw material in the slurry was measured, it was confirmed that D90 is 0.88 μm and almost no large particles having a diameter of 1 μm or more exist in the raw material. This slurry was sprayed by a spray drier into hot air with a temperature of about 130° C., thereby obtaining a dry granulated powder having a particle size of 10 to 100 μm. Moreover, at this time, granulated powder having a particle size of more than 100 μm was removed by a sieve.

This granulated powder was loaded into an electric furnace and fired at a temperature of 1150° C. for 3 hours. At this time, mixed gases of oxygen and nitrogen were flowed into the electric furnace so that the oxygen concentration in the electric furnace becomes 100 ppm. The obtained fired substance was sorted by a sieve after it has been pulverized, and thus, a carrier core material having an average particle size (D50) of 31.0 μm according to embodiment 1 was obtained.

The XRD pattern of the obtained carrier core material according to embodiment 1 was measured and is shown in Table 1 and FIGS. 1 through 3. Moreover, details of the measuring method will be described later.

Moreover, in the present invention, D50 and D90 are indicated as described below. When the entire volume of the carrier core material according to the present invention or raw material of the carrier core material is considered to be 100%, and a cumulative curve of the volume of each particle size is obtained, a particle size at the time when the cumulative curve becomes 50% is indicated as D50 and a particle size at the time when the cumulative curve becomes 90% is indicated as D90. Moreover, in the present invention, the value of D50 is described as an average particle size of the powder.

(Embodiment 2)

A carrier core material having an average particle size (D50) of 29.0 μm according to embodiment 2 was obtained in the same manner as embodiment 1 except that a medium diameter was 1.5 mm in the wet pulverizing process for the slurry.

Moreover, the value of D90 in the particle size distribution of raw material was 0.70 μm.

The XRD pattern of the obtained carrier core material according to embodiment 2 was measured in the same manner as embodiment 1 and is shown in Table 1 and FIG. 1.

(Embodiment 3)

A carrier core material having an average particle size (D50) of 28.8 μm according to embodiment 3 was obtained in the same manner as embodiment 1 except that $Fe_2O_3$ was 6.7 kg and $Mn_3O_4$ was 3.3 kg.

The mixing ratio corresponds to the value x=1.0 in the above-mentioned composition formula of soft ferrite $Mn_xFe_{3-x}O_4$. Moreover, the value of D90 in the particle size distribution of raw material was 0.92 μm.

The XRD pattern of the obtained carrier core material according to embodiment 3 was measured in the same manner as embodiment 1 and is shown in Table 1 and FIG. 3.

(Embodiment 4)

A carrier core material having an average particle size (D50) of 28.2 μm according to embodiment 4 was obtained in the same manner as embodiment 1 except that $Fe_2O_3$ was 9.2 kg and $Mn_3O_4$ was 0.8 kg.

The mixing ratio corresponds to the value x=0.2 in the above-mentioned composition formula of soft ferrite $Mn_xFe_{3-x}O_4$. Moreover, the value of D90 in the particle size distribution of raw material was 0.87 μm.

The XRD pattern of the obtained carrier core material according to embodiment 4 was measured in the same manner as embodiment 1 and is shown in Table 1 and FIG. 3.

(Embodiment 5)

A carrier core material having an average particle size (D50) of 29.0 μm according to embodiment 5 was obtained in the same manner as embodiment 1 except that 10 kg of $Fe_2O_3$ alone was used as the raw material and the fire temperature was set at 1200° C.

This is a magnetite powder represented by x=0, that is, $Fe_3O_4$ in the above-mentioned composition formula of soft ferrite $Mn_xFe_{3-x}O_4$. Moreover, the value of D90 in the particle size distribution of raw material was 0.86 μm.

The XRD pattern of the obtained carrier core material according to embodiment 5 was measured in the same manner as embodiment 1 and is shown in Table 1 and FIG. 3.

(Embodiment 6)

A carrier core material having an average particle size (D50) of 31.2 μm according to embodiment 6 was obtained in the same manner as embodiment 1 except that mixed gases were flowed so that the oxygen concentration in the electric furnace becomes 1000 ppm in the firing process.

The XRD pattern of the obtained carrier core material according to embodiment 6 was measured in the same manner as embodiment 1 and is shown in Table 1 and FIG. 2.

Comparative Example 1

A carrier core material having an average particle size. (D50) of 33.3 μm according to comparative example 1 was obtained in the same manner as embodiment 1 except that the pulverizing process by a wet ball mill was not performed with regard to slurry which becomes a raw material.

Moreover, the value of D90 in the particle size distribution of raw material was 1.40 μm and the existence of large particles in the slurry was confirmed.

The XRD pattern of the obtained carrier core material according to comparative example 1 was measured in the same manner as embodiment 1 and is shown in Table 1 and FIG. 1.

Comparative Example 2

A carrier core material having an average particle size (D50) of 31.2 μm according to comparative example 2 was obtained in the same manner as embodiment 1 except that mixed gases were flowed so that the oxygen concentration in the electric furnace becomes 2000 ppm in the firing process.

The XRD pattern of the obtained carrier core material according to comparative example 2 was measured in the same manner as embodiment 1 and is shown in Table 1 and FIG. 2.

TABLE 1

| | Composition ratio | $O_2$ Concentration (ppm) | Raw material D90 (μm) | D50 (μm) | XRD Half-value width | $\delta_{1000}$ (emu/g) | Amount of carrier scattering |
|---|---|---|---|---|---|---|---|
| Embodiment 1 | x = 0.86 | 100 | 0.88 | 31.0 | 0.141 | 72.8 | 1 (Std. value) |
| Embodiment 2 | x = 0.86 | 100 | 0.70 | 29.0 | 0.115 | 72.8 | 0.7 |
| Embodiment 3 | x = 1.00 | 100 | 0.92 | 28.8 | 0.140 | 72.6 | 1.2 |
| Embodiment 4 | x = 0.20 | 100 | 0.87 | 28.2 | 0.136 | 72.3 | 1.4 |
| Embodiment 5 | x = 0 | 100 | 0.86 | 29.0 | 0.126 | 71.8 | 1.1 |
| Embodiment 6 | x = 0.86 | 1000 | 0.88 | 31.2 | 0.155 | 72.1 | 1.8 |
| Comparative example 1 | x = 0.86 | 100 | 1.40 | 33.3 | 0.172 | 72.5 | 4.2 |
| Comparative example 2 | x = 0.86 | 2000 | 0.88 | 31.2 | 0.182 | 71.9 | 5.3 |

(Summary of Embodiments 1 Through 6 and Comparative Examples 1 and 2)

Table 1 shows the half-value width of the (311) peak, which is the maximum peak, in the powder XRD pattern, magnetic susceptibility, and the amount of carrier scattering in each of the carrier core materials according to embodiments 1 through 6 and comparative examples 1 and 2. Moreover, the amount of carrier scattering in embodiment 1 is standardized as "1", and it is indicated that the amount of carrier scattering increases as the value becomes greater.

<Influence of Raw Material Particle Size>

Influence of the raw material particle size on carrier scattering will be studied according to each XRD pattern.

For the study, measurement results of the XRD pattern for carrier core materials according to embodiments 1 and 2, and comparative example 1 are shown in FIG. 1. The measurement was performed in a range between (2θ/θ) 40.5° and 41.25° where a peak having a maximum intensity appears in $Mn_xFe_{3-x}O_4$.

First, a comparative study was made between embodiment 1 and comparative example 1.

According to FIG. 1, the rise of a peak having a maximum intensity in embodiment 1 is almost the same as the rise of the peak in comparative example 1 when viewed from the low angle side. However, when compared with the peak in embodiment 1, the peak in comparative example 1 is broader being shaped like a skirt trailed on the high angle side. That is, it is considered that the XRD pattern indicates a low existence ratio of low magnetic susceptibility particles in the magnetic powder according to embodiment 1. On the other hand, it is considered to indicate that the magnetic powder according to comparative example 1 contains a large number of particles having a deviated composition which are low magnetic susceptibility particles.

Measurement results of the half-value width in the XRD pattern of the carrier core material according to embodiment 1 and comparative example 1 were 0,141 and 0.172, respectively (these values are shown in Table 1).

Next, embodiment 2 was also studied.

The XRD peak of the carrier core material according to embodiment 2 which uses a finer raw material than that in embodiment 1 has a pattern in which the peak having a maximum intensity is higher than that in embodiment 1 and the width of the peak is narrow. It is considered to indicate that the low magnetic susceptibility particles are further reduced by making the raw material particles fine. The half-value width of the peak in embodiment 2 was 0.115 (this value is shown in Table 1).

Herein, in embodiments 1 and 2 and comparative example 1, the compounding ratio of raw material and firing conditions are the same, but the size of raw material particles is different. Specifically, in embodiments 1 and 2, the value of D90 in the particle size distribution is 1.0 μm or less, and those materials were produced under the conditions where no large raw material particles exist. The data of embodiments 1 and 2 and comparative example 1 shown in Table 1 clearly shows that as the value of D90 of raw material becomes smaller, the half-value width of the XRD peak having a maximum intensity becomes narrower. The reason why the half-value width becomes narrower as the value of D90 becomes smaller is because the raw material particles are uniformly mixed by using a fine raw material, and consequently, the existence ratio of particles having a deviated composition is considered to decrease. Therefore, it is considered that the ratio of low magnetic susceptibility particles generated due to the deviated composition also decreases.

On the other hand, the amount of carrier scattering in comparative example 1 is at a level at which serious problems will arise during electrophotographic development. Therefore, it was discovered that it is necessary to use a carrier core material for an electrophotographic developer wherein the half-value width of the XRD peak having a maximum intensity satisfies 0.160 or less, preferably 0.150 or less, in order to prevent the carrier from scattering for the purpose of achieving excellent electrophotographic development.

<Partial Pressure of Oxygen>

Furthermore, FIG. 2 shows the XRD pattern of the carrier core materials for an electrophotographic developer according to embodiments 1 and 6 and comparative example 2 each of which corresponds to a specimen produced by changing the partial pressure of oxygen in an electric furnace when the carrier core material for an electrophotographic developer was fired. The measurement was performed in a range between (2θ/θ) 40.5° and 41.25° where a peak having a maximum intensity appears in $Mn_xFe_{3-x}O_4$.

As FIG. 2 clearly shows, as the partial pressure of oxygen during the firing process of the carrier core material for an electrophotographic developer becomes higher, the XRD peak shifts toward the high angle side. It is considered to indicate that the carrier core materials for electrophotographic developer according to embodiment 6 and comparative example 2 are affected by oxidation during the firing process. The half-value width of the peak becomes broader as the oxygen concentration becomes higher, and the value is 0.141 in embodiment 1, 0.155 in embodiment 6, and 0.182 in comparative example 2. It is considered that the increase in the half-value width indicates the existence of extremely oxidized particles (these values are shown in Table 1).

In embodiments 1 and 6 and comparative example 2, the partial pressure of oxygen in the firing process is different when producing a carrier core material for an electrophotographic developer represented by a composition formula $Mn_{0.86}Fe_{2.14}O_4$.

As shown in Table 1, as the partial pressure of oxygen in the firing process becomes higher, the half-value width of the XRD peak of the carrier core material for an electrophotographic developer becomes broader, and the amount of carrier scattering increases. This is considered to occur because particles having a deviated amount of oxygen due to excess oxidation during the firing process were generated, and the excessively oxidized particles became low magnetic susceptibility particles. Specifically, the amount of scattering of the carrier core material for an electrophotographic developer according to comparative example 2 which has been fired with the partial oxygen pressure of 2000 ppm is at the level at which serious problems will arise during electrophotographic development.

From these results, it was discovered that it is necessary to set the oxygen atmosphere at less than 1000 ppm, preferably 200 ppm or less, in the firing process of the carrier core material for an electrophotographic developer.

According to the above studies, in the production process of soft ferrite represented by a composition formula $Mn_{0.86}Fe_{2.14}O_4$, it was found possible to produce a carrier core material for an electrophotographic developer which has a narrow half-value width of the XRD peak and results in reduced carrier scattering by setting the D90 value of the raw material to 1.0 μm or less and firing the material in an atmosphere of oxygen concentration of 1000 ppm or less.

<Composition>

Next, study will be made about the influence in the case where the ratio of Mn and Fe in the carrier composition is changed. For the study, FIG. 3 shows the XRD pattern of the carrier core materials for an electrophotographic developer according to embodiment 1, and embodiments 3 through 5 each of which corresponds to a specimen produced by changing the value of x in the above-mentioned composition formula $Mn_xFe_{3-x}O_4$. The measurement was performed in a range between (2θ/θ) 40.5° and 42° where a peak having a maximum intensity appears in $Mn_xFe_{3-x}O_4$ in each embodiment.

As FIG. 3 clearly shows, as the value of x indicating the composition ratio of Mn and Fe becomes smaller, the peak shifts toward the high angle side. This is considered to occur because the radius of $Fe^{2+}$ ions is smaller than that of $Mn^{2+}$ ions. The value of the half-value width of the XRD peak of the carrier core materials for an electrophotographic developer according to embodiments 1 and 3 through 5 produced by a production method according to the present invention did not change much even though the value of x changes, and the values were 0.141, 0.140, 0.136, and 0.126, respectively (the values are shown in Table 1).

Production conditions of embodiments 3 through 5 are the same as those of embodiment 1, however, magnetic powders having a different composition were produced in embodiments 3 through 5. As shown in Table 1, even when the value of x is changed in a range $0 \le x \le 1$ in a composition formula $Mn_xFe_{3-x}O_4$, it was confirmed that a magnetic powder, produced by a production method according to the present invention, having a half-value width of the XRD peak being 1.60 or less can be a carrier core material for an electrophotographic developer capable of preventing the carrier from scattering.

According to the study of embodiments 1 through 6 and comparative examples 1 and 2, it was confirmed that it is possible to obtain a carrier for an electrophotographic developer capable of reducing carrier scattering and having excellent image characteristics by using a carrier core material for an electrophotographic developer, represented by a general formula $Mn_xFe_{3-x}O_4$ (where, $0 \le x \le 1.0$), wherein the half-value width B of the peak having a maximum intensity in the XRD pattern satisfies $B \le 0.160$ (degree).

The measurement method of each characteristic value used for the study of the above-mentioned embodiments 1 through 6 and comparative examples 1 and 2 will be described.

<Particle Size Distribution>

The particle size distribution of raw material and the carrier core material was measured by a Microtrack (made by NIKKISO CO., LTD., Model 9320-X100). Based on the obtained particle size distribution, a cumulative particle size D50 up to the volume ratio of 50% and a cumulative particle size D90 up to the volume ratio of 90% were calculated.

<Magnetic Characteristics>

With regard to magnetic characteristics of the carrier core material, the magnetic susceptibility was measured by a VSM (made by TOEI INDUSTRY CO., LTD., VSM-P7) and a magnetic susceptibility $\sigma_{1000}$ (emu/g) in an external magnetic field 1000 Oe was obtained.

<XRD Pattern>

The powder XRD pattern of the carrier core material was measured by an X-ray diffraction apparatus (made by RIGAKU, RINT2000). Cobalt was used as an X-ray source, and an X-ray was generated at an accelerating voltage of 40 kV with a current of 30 mA. The divergence slit aperture angle was ½°, the scattering slit aperture angle was ½°, and the light-receiving slit width was 0.15 mm. For measuring the half-value width accurately, measurements were performed by a step scan with a measurement interval of 0.002°, a counting time of 5 seconds, and a total cumulative count of 3.

A half-value width was calculated with regard to the peak having a maximum intensity. This is to perform measurements under conditions where there is little influence due to noise. Furthermore, although a peak having a great intensity appears on the low angle side, the influence of a diffraction peak due to Kα2 rays can be ignored on a lower angle side, consequently, highly-reproducible results can be obtained. The half-value width calculation method was performed by measuring the width of the peak at a portion where the intensity becomes half of the maximum intensity of the peak.

Moreover, generally, a carrier for an electrophotographic developer is used in such a way that the carrier core material for an electrophotographic developer is coated with resin. However, because X-rays pass through resin, the shape of the XRD pattern and the value of half-value width of the peak do not change before or after the coating.

<Carrier Scattering>

The amount of carrier scattering of a carrier core material for an electrophotographic developer was measured in such a way that a carrier core material for an electrophotographic developer is loaded into a magnetic drum having a diameter of 50 mm and a surface magnetic force of 1000 Gauss, rotated at 270 rpm for 30 minutes, then scattered particles were collected, and the weight was measured.

Figure 1:
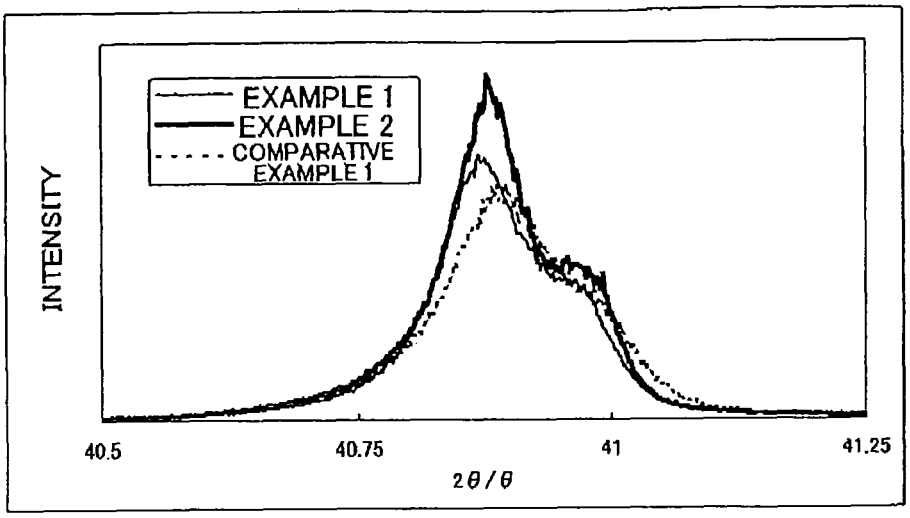
FIG. 1 is an XRD pattern of a carrier core material for an electrophotographic developer according to the present invention.
Figure 2:
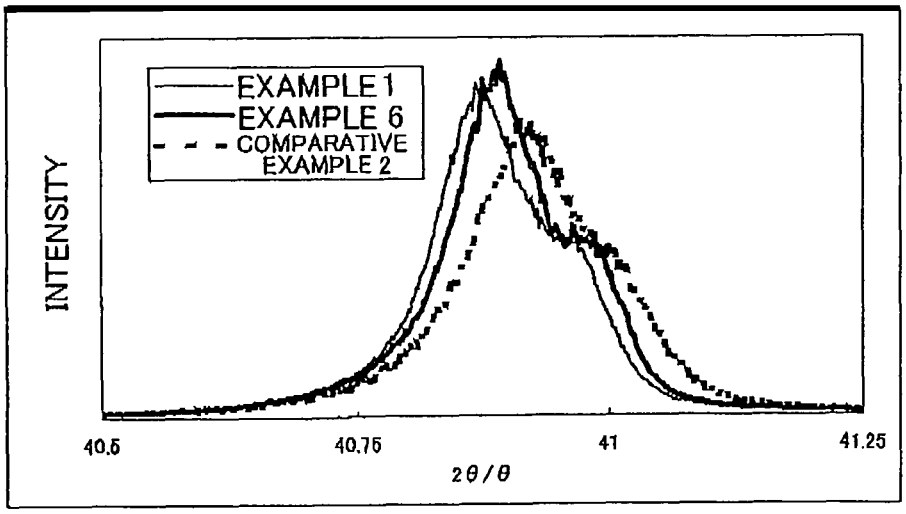
FIG. 2 is an XRD pattern of a carrier core material for an electrophotographic developer according to the present invention.
Figure 3:
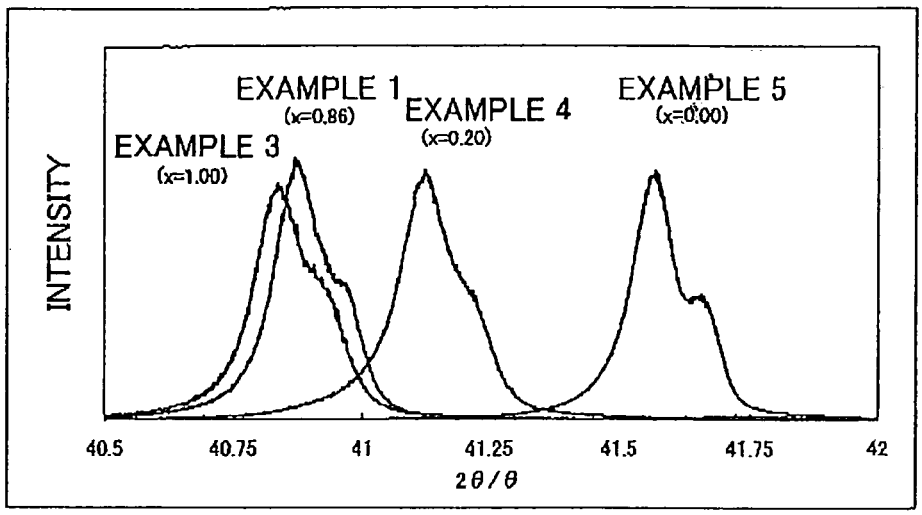
FIG. 3 is an XRD pattern of a carrier core material for an electrophotographic developer according to the present invention.

The invention claimed is:

1. A carrier core material for an electrophotographic developer represented by a chemical formula $Mn_xFe_{3-x}O_4$, where $0 \leq x \leq 1.0$, wherein a half-value width B of a peak having a maximum intensity in a powder XRD obtained by using cobalt as an X-ray source pattern satisfies $B \leq 0.160°$.

2. The carrier core material for an electrophotographic developer according to claim 1, wherein magnetic susceptibility $\sigma_{1000}$ of the carrier core material under an external magnetic field 1000 Oe satisfies $\sigma_{1000} \geq 30$ emu/g.

3. The carrier core material for an electrophotographic developer according to claim 2, wherein an average particle size is 10 μm or more and 80 μm or less.

4. A carrier for an electrophotographic developer that is formed by coating the carrier core material for an electrophotographic developer according to claim 2 with resin.

5. An electrophotographic developer including a carrier for an electrophotographic developer according to claim 4 and a toner.

6. The carrier core material for an electrophotographic developer according to claim 1, wherein an average particle size of the carrier core material is 10 μm or more and 80 μm or less.

7. A carrier for an electrophotographic developer that is formed by coating the carrier core material for an electrophotographic developer according to claim 6 with resin.

8. An electrophotographic developer including a carrier for an electrophotographic developer according to claim 7 and a toner.

9. A carrier for an electrophotographic developer that is formed by coating the carrier core material for an electrophotographic developer according to claim 1 with resin.

10. An electrophotographic developer including a carrier for an electrophotographic developer according to claim 9 and a toner.

* * * * *